US011787029B2

(12) United States Patent
Chigira et al.

(10) Patent No.: US 11,787,029 B2
(45) Date of Patent: Oct. 17, 2023

(54) ELECTRIC STAPLER

(71) Applicant: MAX CO., LTD., Tokyo (JP)

(72) Inventors: Yoshio Chigira, Tokyo (JP); Kazuhiko Kishi, Tokyo (JP); Futoshi Kameda, Tokyo (JP)

(73) Assignee: MAX CO., LTD, Tokyo (JP)

( * ) Notice: Subject to any disclaimer, the term of this patent is extended or adjusted under 35 U.S.C. 154(b) by 234 days.

(21) Appl. No.: 17/015,964

(22) Filed: Sep. 9, 2020

(65) Prior Publication Data

US 2021/0069881 A1 Mar. 11, 2021

(30) Foreign Application Priority Data

Sep. 9, 2019 (JP) ..... 2019-163938
Oct. 2, 2019 (JP) ..... 2019-182489

(51) Int. Cl.
*B25C 5/02* (2006.01)
*B27F 7/36* (2006.01)
*B27F 7/19* (2006.01)

(52) U.S. Cl.
CPC ..... *B25C 5/0228* (2013.01); *B27F 7/36* (2013.01); *B27F 7/19* (2013.01)

(58) Field of Classification Search
CPC ..... B27F 7/19; B27F 7/36; B27F 7/17; B27F 7/21; B25C 5/15; B25C 5/0228; B42C 1/12; G03G 15/6538
See application file for complete search history.

(56) References Cited

U.S. PATENT DOCUMENTS 9,610,795 B2 4/2017 Sato
11,358,825 B2 * 6/2022 Yoshida ..... B65H 37/04
2003/0066858 A1 * 4/2003 Holgersson ..... B27F 7/36 227/2
2004/0060959 A1 4/2004 Ura
2005/0284911 A1 12/2005 Yagi et al.
2007/0289758 A1 * 12/2007 Olson ..... B27F 7/36 173/1
2010/0288814 A1 * 11/2010 Higuchi ..... B27F 7/19 227/107

(Continued)

FOREIGN PATENT DOCUMENTS

JP 2004-122247 A 4/2004
JP 4117457 B2 7/2008

(Continued)

OTHER PUBLICATIONS

European Search Report for Patent Appl. No. 20195224.9 dated Feb. 3, 2021 (7 pages).

*Primary Examiner* — Joshua G Kotis
*Assistant Examiner* — Scott A Howell
(74) *Attorney, Agent, or Firm* — WEIHROUCH IP

(57) ABSTRACT

An electric stapler is configured to perform binding processing including a plurality of processes. The electric stapler includes: a binding unit configured to execute the binding processing for a sheet bundle; a motor configured to drive the binding unit; and a control unit configured to control the motor. The control unit is configured to control the motor; thereby adjusting processing times of the processes so that a binding processing time after the binding processing by the binding unit starts until the binding processing is completed falls within a predetermined range.

18 Claims, 5 Drawing Sheets

(56) References Cited

U.S. PATENT DOCUMENTS

| | | | | |
|---|---|---|---|---|
| 2012/0082497 | A1 | 4/2012 | Nagasaki | |
| 2013/0256969 | A1* | 10/2013 | Isogai | B65H 39/00 270/58.08 |
| 2016/0009116 | A1 | 1/2016 | Sato | |
| 2017/0217004 | A1 | 8/2017 | Kato | |
| 2019/0038371 | A1* | 2/2019 | Wixey | A61B 34/74 |
| 2020/0148498 | A1* | 5/2020 | Ishida | G03G 15/6538 |

FOREIGN PATENT DOCUMENTS

| | | | |
|---|---|---|---|
| JP | 2011-201160 | A | 10/2011 |
| JP | 2016-016596 | A | 2/2016 |

* cited by examiner

FIG.4

| DISTURBANCE ELEMENTS | CONDITIONS UNDER WHICH BINDING PROCESSING TIME IS PROLONGED | CONDITIONS UNDER WHICH BINDING PROCESSING TIME IS SHORTENED |
|---|---|---|
| POWER SUPPLY VOLTAGE | POWER SUPPLY VOLTAGE IS LOW (BECAUSE TORQUE/ROTATION NUMBER OF MOTOR DECREASE) | POWER SUPPLY VOLTAGE IS HIGH (BECAUSE TORQUE/ROTATION NUMBER OF MOTOR INCREASE) |
| MOTOR CHARAC -TERISTIC | MOTOR CHARACTERISTIC IS LOW (BECAUSE TORQUE/ROTATION NUMBER OF MOTOR ARE LOW) | MOTOR CHARACTERISTIC IS HIGH (BECAUSE TORQUE/ROTATION NUMBER OF MOTOR ARE HIGH) |
| NUMBER OF SHEETS | NUMBER OF SHEETS IS LARGE (BECAUSE LOAD IS HIGH UPON PENETRATION INTO SHEET) | NUMBER OF SHEETS IS SMALL (BECAUSE LOAD IS HIGH UPON PENETRATION INTO SHEET) |
| QUALITY OF SHEET | RIGID, THICK (BECAUSE LOAD IS HIGH UPON PENETRATION INTO SHEET) | SOFT, THIN (BECAUSE LOAD IS LOW UPON PENETRATION INTO SHEET) |
| TEMPERATURE / HUMIDITY | LOW TEMPERATURE / LOW HUMIDITY (BECAUSE LOAD IS HIGH UPON PENETRATION INTO SHEET) | HIGH TEMPERATURE / HIGH HUMIDITY (BECAUSE LOAD IS HIGH UPON PENETRATION INTO SHEET)) |
| MACHINE LOAD | MACHINE LOAD SUCH AS SLIDING IS HIGH (BECAUSE ENTIRE LOAD BECOMES HIGHER) | MACHINE LOAD SUCH AS SLIDING IS LOW (BECAUSE ENTIRE LOAD BECOMES LOWER) |

ELECTRIC STAPLER

CROSS-REFERENCE TO RELATED APPLICATIONS

This application is based upon and claims the benefit of priority from prior Japanese patent application No. 2019-163938, filed on Sep. 9, 2019 and Japanese patent application No. 2019-182489, filed on Oct. 2, 2019, the entire contents of which are incorporated herein by reference.

TECHNICAL FIELD

The present disclosure relates to an electric stapler.

BACKGROUND

In the related art, it is available an electric stapler configured to automatically bind a sheet bundle by a staple (for example, Patent Literature 1). In the electric stapler, a driver mechanism is driven by a motor to strike a staple into a sheet bundle and leg portions of the staple having penetrated the sheet bundle are bent by a clincher, so that binding processing is performed.

Patent Literature 1: Japanese Patent No. 4,117,457B

In the electric stapler of the related art, a binding processing time may vary due to an influence of disturbances such as variation in voltage of a power supply, individual differences (characteristics) of motors, individual differences of electric staplers, the number of sheets, a quality of sheet, a temperature, a humidity and the like.

For example, when the binding processing time becomes slower than a target binding processing time due to the influence of the disturbances, as the number of times of the binding processing increases, the total binding processing time cumulatively increases and efficiency of the entire binding processing operation is lowered.

It is therefore an object of the present disclosure to provide an electric stapler in which a binding processing time falls within a predetermined range even when affected by a. disturbance.

SUMMARY OF DISCLOSURE

According to the disclosure, there is provided an electric stapler configured to perform binding processing including a plurality of processes, the electric stapler comprising: a binding unit configured to execute the binding processing for a sheet bundle; a motor configured to drive the binding unit; and a control unit configured to control the motor, wherein the control unit is configured to control the motor, thereby adjusting processing times of the processes so that a binding processing time after the binding processing by the binding unit starts until the binding processing is completed falls within a predetermined range.

According to an aspect of the present disclosure, the electric stapler controls the motor to adjust the processing times of respective processes so that the binding processing time after the binding processing starts until the binding processing is over falls within the predetermined range. Therefore, the binding processing time is not varied even when affected by the disturbance.

BRIEF DESCRIPTION OF DRAWINGS

FIG. 4 depicts a relation between a disturbance element and a binding processing time.

DESCRIPTION OF EMBODIMENTS

First Embodiment

Configuration Example of Electric Stapler 20

Figure 1A:
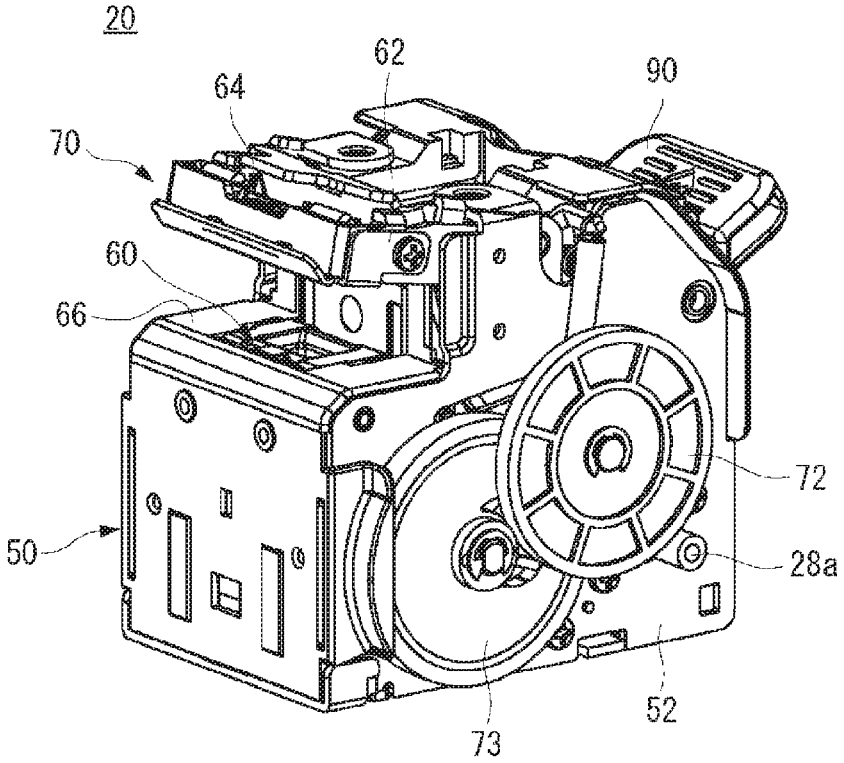
FIG. 1A is a perspective view of an electric stapler in accordance with a first embodiment, as seen from the front.
Figure 1B:
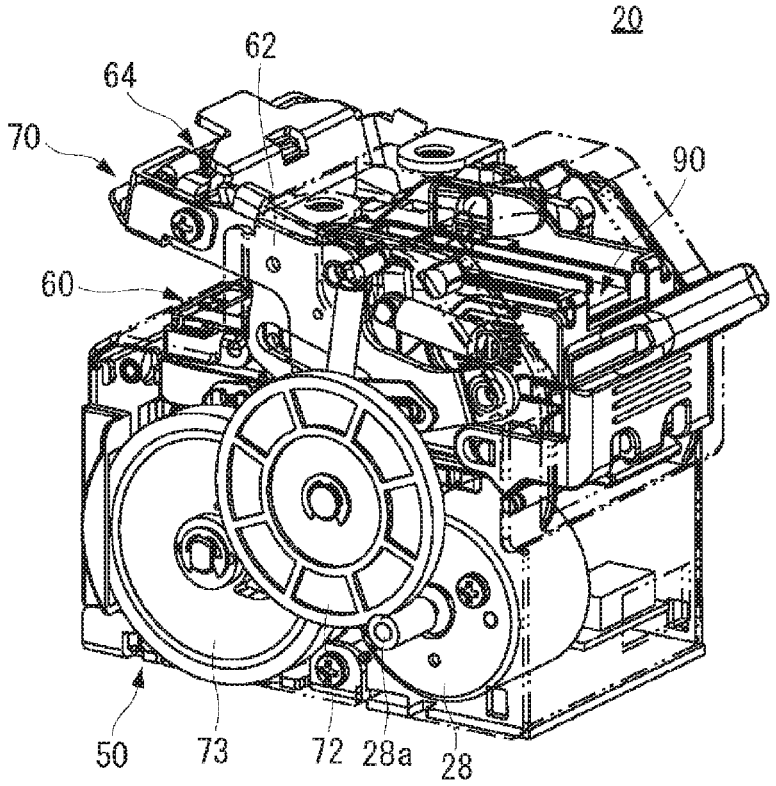
FIG. 1B a perspective view of an inside of the electric stapler in accordance with the first embodiment, as seen from the rear.
Figure 2:
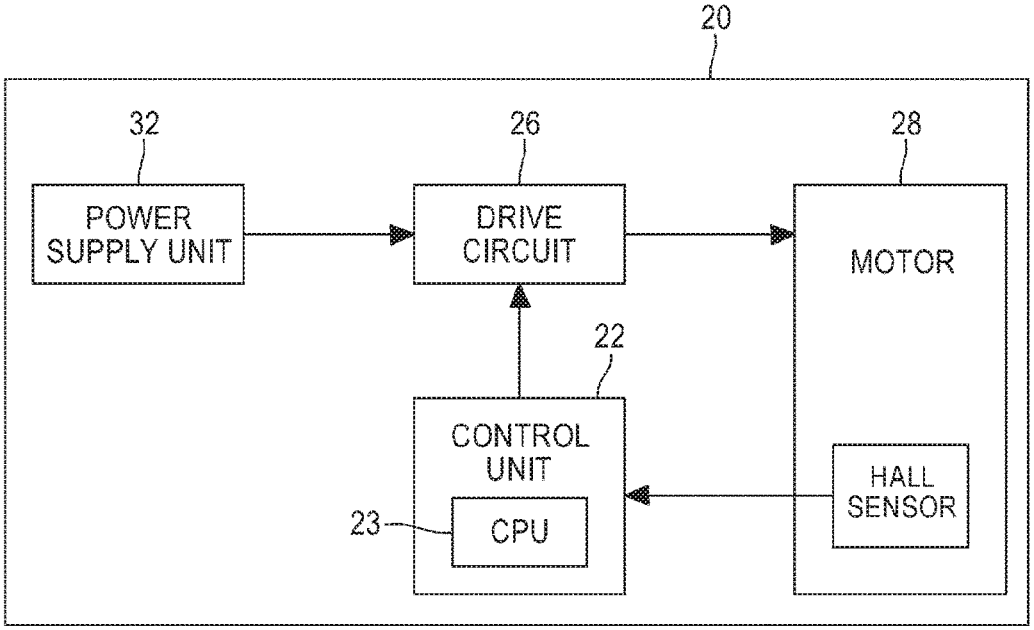
FIG. 2 is a block diagram of the electric stapler in accordance with the first embodiment.

FIG. 1A is a perspective view of an electric stapler 20, as seen from the front, which is a binding processing device in accordance with an embodiment, and FIG. 1B a perspective view of an inside of the electric stapler 20 in accordance with the embodiment, as seen from the rear. Also, FIG. 2 is a block diagram of the electric stapler 20 in accordance with the embodiment. In the meantime, in FIGS. 1A and 1B, a side of the electric stapler 20 on which a driver mechanism 60 is disposed is referred to as a front side of the electric stapler 20, and an opposite side thereof is referred to as a rear side of the electric stapler 20. Also, a side of the electric stapler 20 on which gears 72 and 73 are provided is a referred to as a left side of the electric stapler 20, and an opposite side thereof is referred to as a right side of the electric stapler 20. Also, a side (bottom wall-side of a main body part 50) on which a motor 28 is disposed is referred to as a lower side of the electric stapler 20, and an opposite side thereof is referred to as an upper side of the electric stapler 20.

The electric stapler 20 is configured to execute binding processing including a plurality of processes, and includes a binding unit 70 configured to execute the binding processing for a sheet bundle, a motor 28 configured to drive the binding unit 70, and a control unit 22 configured to control the motor 28. The motor 28 and the control unit 22 are accommodated in a main body part 50. In the main body part 50, a drive circuit 26 configured to drive the motor 28 and the control unit 22 is also accommodated with being mounted on a substrate.

The binding unit 70 includes a driver mechanism 60 configured to strike out a staple toward the sheet bundle, a clincher arm 62 provided to be rotatable with respect to the driver mechanism 60, and a clincher part 64 attached to the clincher arm 62 and configured to bend leg portions of the staple having been struck out by the driver mechanism 60 and having penetrated a sheet. A placement 66 on which a sheet bundle is to be placed is provided in a position above the driver mechanism 60 and facing the clincher part 64.

The driver mechanism 60 is disposed in a front side of the main body part 50 and is configured to move up and down relative to the placement 66 as the motor 28 is driven. The driver mechanism 60 is configured to bend both ends of a staple into a substantial U-shape by a forming plate (not shown), and to strike out the staple formed into the U-shape toward the sheet bundle by a driver (not shown).

The clincher arm 62 is provided to be rotatable on an upper side of the driver mechanism 60, and is configured so that a front end side thereof can move toward and away from the driver mechanism 60. The clincher part 64 is provided at a front end portion of the clincher arm 62, and is configured to bind the sheet bundle with the staple by bending inwardly leg portions of the staple having penetrated the sheet bundle in cooperation with the driver mechanism 60.

A cartridge 90 is detachably attached to the main body part 50. In the cartridge 90, a refill in which sheet-shaped coupled staples are stacked is accommodated. The coupled staples in the refill of the cartridge 90 are conveyed to a forming position by a delivery mechanism (not shown) of the driver mechanism 60.

The motor 28 is disposed in a rear side of the main body part 50 and below the cartridge 90. The gears 72 and 73 configured to rotate in conjunction with drive of the motor 28 are attached to an outer surface of a left sidewall 52. The gear 72 is connected to a rotary shaft 28*a* of the motor 28, and the gear 73 is connected to the gear 72. A swing arm (not shown) is directly or indirectly connected between the gear 73 and the binding unit 70 such as the driver mechanism 60, the clincher part 64 and the like, so that the driver mechanism 60, the clincher part 64 and the like are driven in conjunction with rotation of the gear 73.

The motor 28 is configured by a brushless motor including a rotor and a stator, and is configured to rotate at a predetermined speed on the basis of a voltage that is supplied from the drive circuit 26. The motor 28 has a Hall sensor 30 embedded therein. The Hall sensor 30 is configured to detect a magnet polarity of the rotor, thereby outputting position signals (the number of rotations of the motor 28) indicative of positions of the rotor to the control unit The control unit 22 includes a CPU (Central Processing Unit) 23. The CPU 23 is configured to implement predetermined binding processing by executing a variety of programs stored in a storage unit (not shown). Also, the control unit 22 is configured to generate a drive signal for driving the drive circuit 26, based on the position signals from the Hall sensor 30 of the motor 28, a set command value and the like, and to output the generated drive signal to the drive circuit 26. Specifically, the control unit 22 is configured to calculate a rotating speed of the motor 28, based on the positions signals from the Hall sensor 30 and the like, and to generate a drive signal so as to follow a preset target rotating speed of the motor 28. The control unit 22 is configured to regulate a duty ratio of a PWM (Pulse Width Modulation) in the drive circuit 26, based on the generated drive signal.

The drive circuit 26 includes an inverter having a plurality of switching elements, and is configured to control the rotating speed of the motor 28 by the inverter. As the switching element, for example, a MOSFET (electric field transistor), an IGBT (insulated gate bipolar transistor) and the like can be used. The drive circuit 26 is configured to control on and off states of the switching elements, based on the drive signal supplied from the control unit 22, to regulate a voltage, Which is supplied from the power supply unit 32 to the motor 28, and to output the regulated voltage to the motor 28. In the meantime, the drive circuit 26 may also be embedded in the motor 28.

In the present embodiment, while the gear 73 and the like rotate by one revolution (360° rotation), a clamp process of moving the clincher part 64 down e sheet bundle between the clincher part and the placement 66, a penetration process of causing the leg portions of the staple to penetrate the sheet bundle by upward movement of the driver mechanism 60, and a clinch process of bending the leg portions of the staple having penetrated the sheet bundle by the clincher part 64, and a return process of returning the clincher part 64, the driver mechanism 60 and the like to the home position are executed.

Operation Example of Electric Stapler 20

An example of the operation of the electric stapler 20 is described.

Before the drive of the motor 28 starts and immediately after the drive of the motor 28 starts, the clincher part 64 is disposed in an uppermost position of a moving range, and the driver of the driver mechanism 60 is disposed in a lowest position of the moving range (hereinbelow, referred to as a home position).

When a sheet bundle consisting of a plurality of sheets is placed on the placement 66 of the electric stapler 20 and an operation for starting the binding processing is performed, an operation start signal is supplied to the control unit 22. The control unit 22 starts the drive of the motor 28, based on the operation start signal. In association with the drive, the gears 72 and 73 rotate. As the gear 73 and the like rotate, the clincher part 64 moves toward the placement 66 and the sheet bundle is clamped by the clincher part 64 and the placement 66 (clamp process).

Also, when the gear 73 rotates by a predetermined angle, the forming plate of the driver mechanism 60 moves upward to bend a staple of the coupled staples located in the tip end position into a substantial U-shape. At the same time, the driver of the driver mechanism 60 moves toward the placement 66 to push out the staple bent into a U-shape toward the sheet bundle, thereby causing the leg portions of the staple to penetrate the sheet bundle in a thickness direction (penetration process).

Continuously, when the gear 73 rotates by a predetermined angle, the clincher part 64 is driven to bend inwardly the leg portions of the staple protruding from the top surface of the sheet bundle, so that the sheet bundle is bound with the staple (clinch process).

Also, when the gear 73 rotates to a position close to the home position about by one revolution, the clincher part 64 moves upward to return to the home position, and the driver of the driver mechanism 60 moves downward to return to the home position (return process). In this way, while the gear 73 rotates by one revolution, a series of binding processing including the clamp process, the penetration process, the clinch process and the return process is executed.

Control Example During Binding Processing

Figure 3:
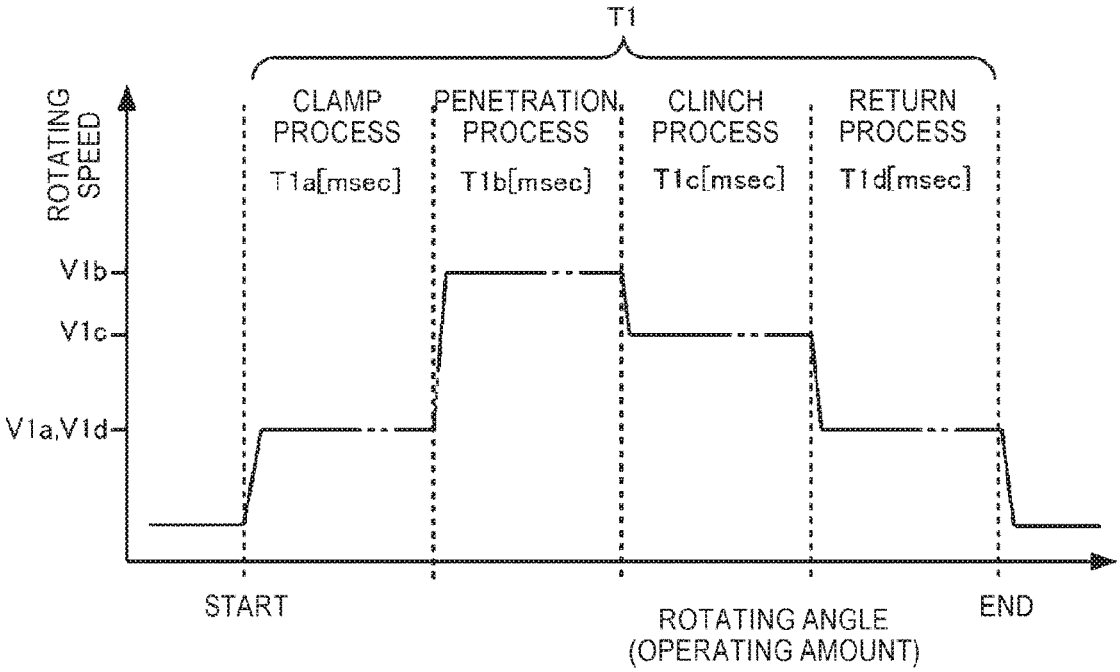
FIG. 3 is a graph depicting a relation between a rotating speed of a motor and a rotating angle of a gear during binding processing in respective processes in accordance with the first embodiment.

Subsequently, an example of control that is performed during the binding processing of the first embodiment is described. FIG. 3 is a graph depicting a relation between a rotating speed of the motor 28 and a rotating angle of the gear 73 during binding processing in respective processes in accordance with the first embodiment. In FIG. 3, the vertical axis indicates the rotating speed of the motor 28, and the horizontal axis indicates the rotating angle (operating amount) of the gear 73.

The binding processing in the electric stapler 20 is executed in order of the clamp process, the penetration process, the clinch process and the return process, as described above.

As shown in FIG. 3, in the first embodiment, a target processing time of the clamp process is referred to as a first processing time T1*a*, a target processing time of the penetration process is referred to as a second processing time T1*b*, a target processing time of the clinch process is referred to as a third processing time T1*c*, and a target processing time of the return process is referred to as a fourth processing time T1*d*, and a sum of the processing times T1*a*, T1*b*, T1*c* and T1*d* of the respective processes is referred to as a binding processing time T1.

The control unit 22 drives the motor 28 to adjust the processing times T1*a*, T1*b*, T1*c* and T1*d* of the respective processes so that the binding processing time T1 after the binding processing by the binding unit 70 starts until the binding processing is completed falls within a predetermined range.

As used herein, the description "the binding processing time T1 falls within the predetermined range" means that the binding processing time T1 is TC±α when an intermediate value of the binding processing time T1 is referred to as TC, for example. In this case, α is about 30 msec, preferably about 20 msec, and more preferably about 10 msec, considering efficiency of the binding processing operation, an influence of the disturbance, and the like.

In the present embodiment, the control unit 22 adjusts the processing times T1*a*, T1*b*, T1*c* and T1*d* of the respective processes so that the binding processing time T1 is constant or substantially constant. That is, the control unit 22 controls the motor 28 so that the binding processing time T1, the first processing time T1*a*, the second processing time T1*b*, the third processing time T1*c* and the fourth processing time T1*d* satisfy a following equation $$T1[\text{msec}]=T1a+T1c+T1d \quad (1)$$

The above "substantially constant" means that it includes a range slightly deviated from a perfectly "constant". In the present disclosure, "constant" has a meaning including both "constant" and "substantially constant".

In the meantime, the first processing time T1*a*, the second processing time T1*b*, the third processing time T1*c* and the fourth processing time T1*d* are different from each other but may be set as the same time.

Herein, the first processing time T1*a*, the second processing time T1*b*, the third processing time T1*c*, the fourth processing time T1*d* and the binding processing time T1 can be preset, considering at least one element of a sound generated during the binding processing, productivity of the sheet bundle, and an influence of the disturbance. For example, for a process in which the rotating speed of the motor 28 tends to decrease due to the influence of the disturbance, the control is performed so that the rotating speed of the motor 28 becomes relatively faster than other processes. In the meantime, the disturbance elements may include a power supply voltage, a motor characteristic, the number of sheets of a sheet bundle, a quality of a sheet, a temperature, a humidity, a machine load and the like, for example.

FIG. 4 depicts a relation between the disturbance element and the binding processing time. For example, in a case where the disturbance element is a power supply voltage, when the power supply voltage decreases, the torque and rotation number of the motor 28 decrease, so that the binding processing time becomes longer. On the other hand, when the power supply voltage increases, the torque and rotation number of the motor 28 increase, so that the binding processing time becomes shorter. Also, in a case where the disturbance element is a machine load, when the machine load such as sliding increases during an operation of the electric stapler 20, the entire load of the electric stapler 20 also increases, so that the binding processing time becomes longer. On the other hand, when the machine load such as sliding decreases during an operation of the electric stapler 20, the entire load of the electric stapler 20 also decreases, so that the binding processing time becomes shorter.

In the first embodiment, in order to suppress variation in the binding processing time due to the influence of the disturbance shown in FIG. 4, when it is expected that the binding processing time T1 will be longer than a reference (target time) due to the influence of the disturbance, (at least a part of) the processing times of the processes are adjusted so that the binding processing time T1 becomes shorter by the influence of the disturbance, i.e., the binding processing time T1 becomes a target time, irrespective of the influence of the disturbance. In this case, for a process in which the processing time tends to be longer due to the influence of the disturbance, the motor 28 is controlled so that the processing time becomes relatively shorter than other processes, thereby controlling the binding processing time T1 to approach the target time. On the other hand, when it is expected that the binding processing time will be shorter than the reference due to the influence of the disturbance, (at least a part of) the processing times of the processes are adjusted so that the binding processing time T1 becomes longer by the influence of the disturbance. For example, for a process in which the processing time tends to be shorter due to the influence of the disturbance, the motor 28 is controlled so that the processing time becomes relatively longer than other processes.

Herein, in the penetration process, since the load that is applied when driving the driver mechanism 60 to cause the leg portions of the staple to penetrate the sheet bundle, i.e., the load that is applied to the driver mechanism 60 is high, the penetration process is a process that is most influenced by the machine load. Also, in the clinch process, the load that is applied when bending the leg portions of the staple having penetrated the sheet bundle by the clincher part 64, i.e., the load that is applied to the clincher part 64 is high.

Therefore, in the first embodiment, the rotating speed of the motor 28 in the penetration process is set to a rotating speed V1*b* that is the highest in the binding processing process, and the rotating speed of the motor 28 in the clinch process is set to a rotating speed V1*c* that is the second highest in the binding processing process. The rotating speeds of the motor 28 in the clamp process and the return process are set to rotating speeds V1*a* and V1*d* that are lower than the rotating speed of the motor 28 V1*c* in the clinch process. In the present embodiment, the rotating speeds V1*a* and V1*d* of the motor 28 in the clamp process and the return process are set to be the same. In the meantime, the rotating speeds of the motor 28 in the clamp process and the return process are set to be the same but the rotating speeds may be set different.

Figure 5:
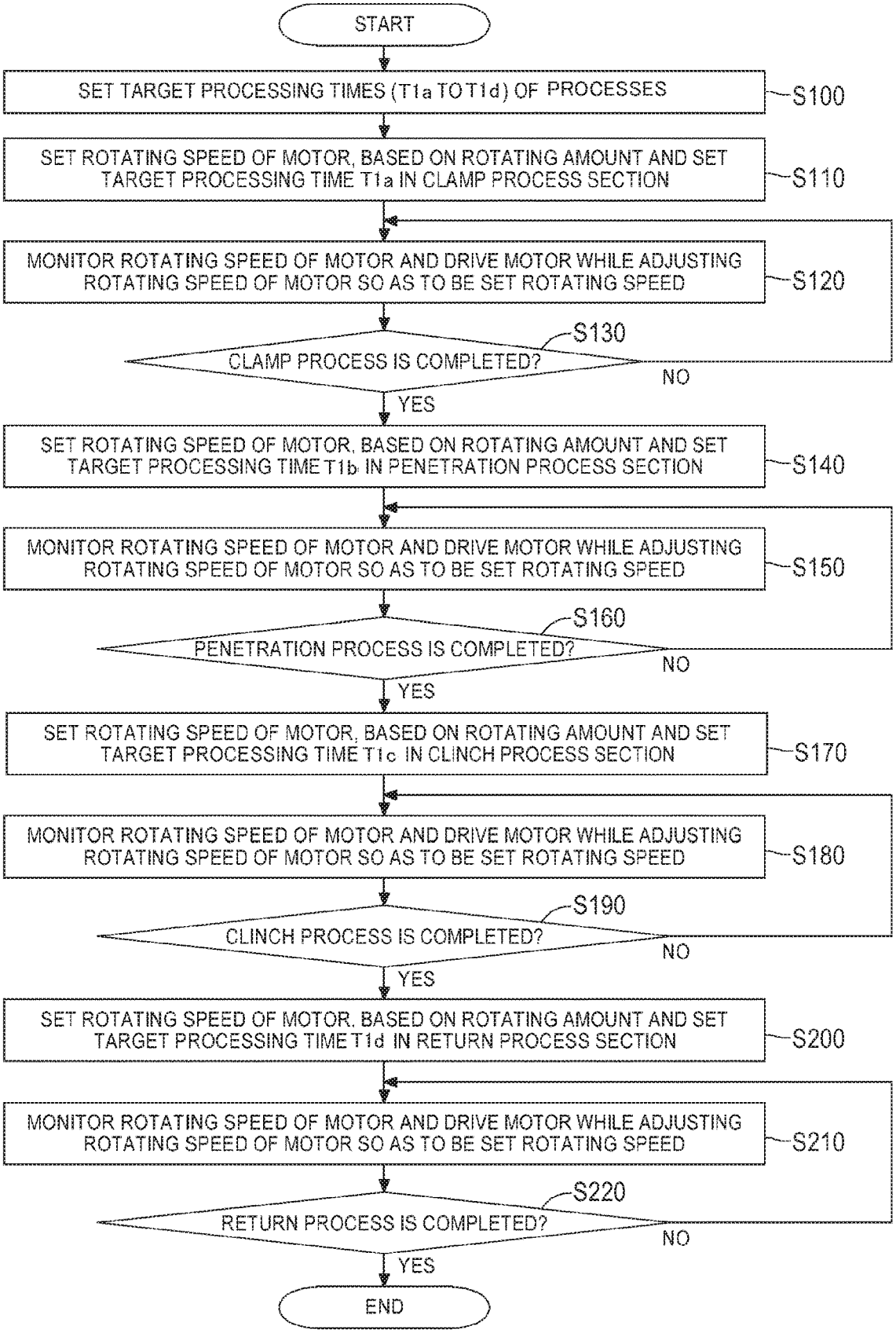
FIG. 5 is a flowchart depicting an example of an operation of the electric stapler during binding processing in accordance with the first embodiment.

Operation Example of Electric Stapler 20 During Binding Processing of Each Process FIG. 5 is a flowchart depicting an example of an operation of the electric stapler 20 during binding processing of each process in accordance with the first embodiment. The control unit 22 executes a program stored in the storage unit, thereby controlling the motor 28 so that the processing time of each process falls within the target value.

In step S100, the target processing times T1*a*, T1*b*, T1*c* and T1*d* of the respective processes are read (set) from the storage unit.

In step S110 to S130, the motor 28 is controlled in the clamp process.

In step S110, a target rotating speed of the motor 28 is set, based on a range of the rotating angle of the gear 73 and the first processing time T1*a* as the target processing time in the clamp process section. The target rotating speed of the motor 28 is, for example, the rotating speed V1*a*, as shown in FIG. 3.

In step S120, the control unit 22 monitors the rotating speed of the motor 28 based on the position signals of the motor 28 from the Hall sensor 30, and controls the motor 28 so that the actual rotating speed of the motor 28 is to follow the set rotating speed V1*a* of the motor 28.

In step S130, the control unit 22 determines whether the clamp process is completed. When it is determined that the clamp process is not completed, the control unit 22 returns to step S120, and continues to adjust the rotating speed of the motor 28. On the other hand, when it is determined that the clamp process is completed, the control unit 22 proceeds to step S140. The control unit 22 determines whether the clamp process is completed, depending on whether the rotating amount of the motor 28 calculated from the position signals from the Hall sensor 30 reaches a predetermined amount.

In the meantime, in the completion stage of the clamp process, the control unit 22 may compare the first processing time T1*a* as the target processing time and the actual processing time, and when there is still a difference, the control unit 22 may perform control of supplementing the difference in any one of subsequent processes.

Then, in step S140 to S160, the motor 28 is controlled in the penetration process.

In step S140, the target rotating speed of the motor 28 is set, based on the range of the rotating angle of the gear 73 and the second processing time T1*b* as the target processing time in the penetration process section. The target rotating speed of the motor 28 is, for example, the rotating speed V1*b*, as shown in FIG. 3.

In step S150, the control unit 22 monitors the rotating speed of the motor 28, based on the position signals of the motor 28 from the Hall sensor 30, and controls the motor 28 so that the actual rotating speed of the motor 28 is to follow the set rotating speed V1*b* of the motor 28.

In step S160, the control unit 22 determines whether the penetration process is completed. When it is determined that the penetration process is not completed, the control unit 22 returns to step S150, and continues to adjust the rotating speed of the motor 28. On the other hand, when it is determined that the penetration process is completed, the control unit 22 proceeds to step S170. The control unit 22 determines whether the penetration process is completed, depending on whether the rotating amount of the motor 28 calculated from the position signals from the Hall sensor 30 has reached a predetermined amount.

In the meantime, in the completion stage of the penetration process, the control unit 22 may compare the second processing time T1*b* as the target processing time and the actual processing time, and when there is a difference, the control unit 22 may perform control of supplementing the difference in any one of subsequent processes.

Then, in step S170 to S190, the motor 28 is controlled in the clinch process.

In step S170, the target rotating speed of the motor 28 is set, based on the range of the rotating angle of the gear 73 and the third processing time T1*c* as the target processing time in the clinch process section. The target rotating speed of the motor 28 is, for example, the rotating speed V1*c*, as shown in FIG. 3.

In step S180, the control unit 22 monitors the rotating speed of the motor 28, based on the position signals of the motor 28 from the Hall sensor 30, and controls the motor 28 so that the actual rotating speed of the motor 28 is to follow the set rotating speed V1*c* of the motor 28.

In step S190, the control unit 22 determines whether the clinch process is completed. When it is determined that the clinch process is not completed, the control unit 22 returns to step S180, and continues to adjust the rotating speed of the motor 28. On the other hand, when it is determined that the clinch process is completed, the control unit 22 proceeds to step S200. The control unit 22 determines whether the clinch process is completed, depending on whether the rotating amount of the motor 28 calculated from the position signals from the Hall sensor 30 has reached a predetermined amount.

In the meantime, in the completion stage of the clinch process, the control unit 22 may compare the third processing time T1*c* as the target processing time and the actual binding processing time, and when there is a difference, the control unit 22 may perform control of supplementing the difference in any one of subsequent processes.

Then, in step S200 to S220, the motor 28 is controlled in the return process.

In step S200, the target rotating speed of the motor 28 is set, based on the range of the rotating angle of the gear 73 and the fourth processing time T1*d* as the target processing time in the return process section. The target rotating speed of the motor 28 is, for example, the rotating speed V1*d*, as shown in FIG. 3.

In step S210, the control unit 22 monitors the rotating speed of the motor 28, based on the position signals of the motor 28 from the Hall sensor 30, and controls the motor 28 so that the actual rotating speed of the motor 28 is to follow the set rotating speed V1*d* of the motor 28.

In step S220, the control unit 22 determines whether the return process is completed. When it is determined that the return process is not completed, the control unit 22 returns to step S210, and continues to adjust the rotating speed of the motor 28. On the other hand, when the return process is completed, the series of binding processing is completed. The control unit 22 determines whether the return process is completed, depending on whether the rotating amount of the motor 28 calculated from the position signals from the Hall sensor 30 has reached a predetermined amount.

As described above, according to the first embodiment, since the rotating speed of the motor 28 is controlled so that the sum of the processing times T1*a*, T1*b*, T1*c* and T1*d* of the respective processes is to be the preset binding processing time T1, it is possible to suppress variation in the binding processing time, irrespective of the influence of the disturbance, and to keep the binding processing time constant or substantially constant.

Second Embodiment

A second embodiment is different from the first embodiment, in that the processing times of the processes are set to be the same, considering the influence of the disturbance. In the meantime, since the other configurations and operations of the electric stapler 20 are common to the first embodiment, the detailed descriptions thereof are omitted.

Control Example During Binding Processing

Figure 6:
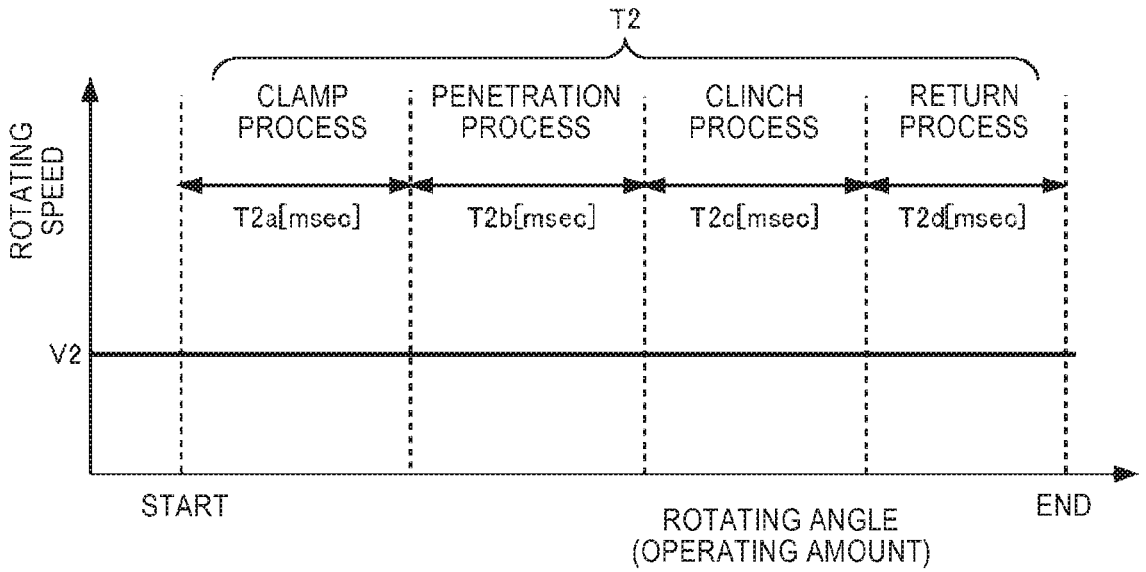
FIG. 6 is a graph depicting the relation between the rotating speed of the motor and the rotating angle of the gear during binding processing in a plurality of modes in accordance with a second embodiment.

FIG. 6 is a graph depicting the relation between the rotating speed of the motor 28 and the rotating angle of the gear 73 during binding processing in each process when the processing times are set to be the same in accordance with the second embodiment. In the meantime, the vertical axis indicates the rotating speed of the motor 28, and the horizontal axis indicates the rotating angle (operating amount) of the gear 73.

The control unit 22 performs control so that the rotating speed of the motor 28 in each process of the clamp process, the penetration process, the clinch process and the return process is to be a constant rotating speed V2. That is, the control unit 22 adjusts the rotating speed of the motor 28 so as to follow the target rotating speed V2, based on the position information and the like of the motor 28.

The control unit 22 drives the motor 28 to adjust the processing times of the processes so that the actual binding processing time is to be the binding processing time T2. That is, a binding processing time T2, a first processing time T2*a*, a second processing time T2*b*, a third processing time T2*c* and a fourth processing time T2*d* satisfy a following equation (2).

$$T2[\text{msec}]=T2a+T2b+T2c+T2d \quad (2)$$

The first processing time T2*a*, the second processing time T2*b*, the third processing time T2*c* and the fourth processing time T2*d* in the equation (2) are different from each other but may be set as the same time.

In the meantime, the flowchart of FIG. 5 described in the first embodiment can be applied to the operations of the electric stapler 20 during the binding processing of each process in accordance with the second embodiment. That is, in each process, while the control unit 22 adjusts the rotating speed of the motor 28 to be a target value, based on the rotating speed of the motor 28 obtained by the detection result of the Hall sensor 30, the control unit executes the binding processing so that the sum of the processing times of the respective processes falls within the preset binding processing time range.

As described above, according to the second embodiment, since the rotating speed of the motor 28 is controlled in each mode so that the processing times of the processes are to be the preset binding processing time, similarly to the first embodiment, it is possible to suppress variation in the binding processing time in the electric stapler 20, irrespective of the influence of the disturbance. Also, since the processing times of the processes are set, considering the influence of the disturbance, even when the disturbance occurs, it is possible to suppress variation in the binding processing time, and to keep the binding processing time constant.

Third Embodiment

A third embodiment is different from the first embodiment, in that the binding processing time has a plurality of different modes. In the meantime, since the other configurations and operations of the electric stapler 20 are common to the first embodiment, the detailed descriptions thereof are omitted.

Control Example During Binding Processing

Figure 7:
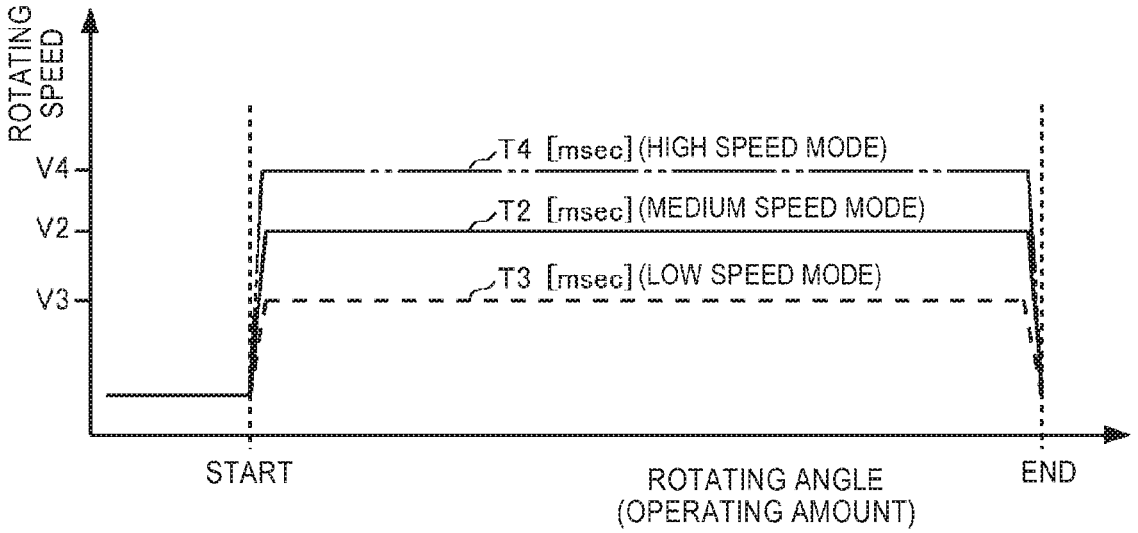
FIG. 7 is a graph depicting the relation between the rotating speed of the motor and the rotating angle of the gear during binding processing in respective processes where binding processing times are different, in a third embodiment.

FIG. 7 is a graph depicting the relation between the rotating speed of the motor 28 and the rotating angle of the gear 73 during binding processing in the plurality of modes in accordance with the third embodiment. In the meantime, the vertical axis indicates the rotating speed of the motor 28, and the horizontal axis indicates the rotating angle (operating amount) of the gear 73.

In the third embodiment, the control unit 22 selects any one mode, in response to a command from an outside, and adjusts the processing times of the processes so as to be the binding processing time corresponding to the selected mode. As used herein, the "outside" is an operation unit provided for the electric stapler 20 when the electric stapler 20 is used as a single body, for example, and is an operation unit provided for a post-processing apparatus when the electric stapler 20 is embedded in the post-processing apparatus or an image forming apparatus. Also, a program for executing each mode is stored in the storage unit, for example.

One of the plurality of modes is a mode (medium speed mode) in which the binding processing is executed in a binding processing time T2 shown in FIG. 7 and the binding processing time T1 is set faster while suppressing the sound generated during the binding processing as much as possible, in other words, a mode in the binding processing time T1 and the suppression of the generated sound are made to be compatible. Another of the plurality of modes is a low speed (low sound) mode in which the target binding processing time is set to be slower than that of the medium speed mode. The low speed mode is a mode in which the target binding processing time is a binding processing time T3 and the binding processing time T3 is set slower to further suppress the sound generated during the binding processing than during the execution in the medium speed mode. The remaining one of the plurality of modes is a high speed mode in which the processing time is set faster than the medium speed mode. In the high speed mode, the target binding processing time is a binding processing time T4, the generated sound is louder than that in the medium speed mode because the binding processing time T4 is faster, and the improvement in productivity can be implemented as compared to the medium speed mode.

When the low speed mode is selected, the control unit 22 controls the rotating speed of the motor 28 to adjust the processing times of the clamp process, the penetration process, the clinch process and the return process so that the target binding processing time is to be the binding processing time T3. Also, in the low speed mode, the control unit 22 controls the rotating speed of the motor 28 in each process of the clamp process, the penetration process, the clinch process and the return process so as to be the constant rotating speed V3 slower than the rotating speed V2 in the medium speed mode.

Similarly, when the high speed mode is selected, the control unit 22 controls the rotating speed of the motor 28 to adjust the processing times of the clamp process, the penetration process, the clinch process and the return process so that the target binding processing time is to be the binding processing time T4. Also, in the high speed mode, the control unit 22 controls the rotating speed of the motor 28 in each process of the clamp process, the penetration process, the clinch process and the return process so as to be the constant rotating speed V4 faster than the rotating speed V2 in the medium speed mode.

As described above, according to the third embodiment, similarly to the first embodiment, the rotating speed of the motor 28 is controlled so that the sum of the processing times of the respective processes in each mode is to be the preset binding processing time. Therefore, it is possible to suppress the variation in the binding processing time in the electric stapler 20, irrespective of the influence of the disturbance. Also, the plurality of modes is provided, so that it is possible to select the mode, depending on the use environment, the use purpose and the like.

In the first to third embodiments, although the embodiments of the present disclosure have been described in detail with reference to the drawings, the embodiments are provided just to illustrate the present disclosure, not to limit the present disclosure. Also, the embodiments can be diversely modified and changed without departing from the essence and scope of the present disclosure.

For example, in the respective embodiments, the example where the brushless motor is used as the motor 28 has been described. However, the present disclosure is not limited thereto. For example, a brush motor can be used as the motor 28. In this case, a rotation detection unit configured to detect rotation information (rotating angle) of the gear 73 and the like is provided, and the rotation of the motor 28 is adjusted by detecting the rotating angles of the gear 73 and the like, based on the rotation information detected by the rotation detection unit.

Also, in the respective embodiments, the example where the rotating speed of the motor 28 in each process is set constant has been described. However, the present disclosure is not limited thereto. For example, the rotating speed of the motor 28 in each process may be controlled in a variable manner.

Also, the disturbance such as a power supply voltage, a motor characteristic, the number of sheets of a sheet bundle, a quality of a sheet, a temperature, a humidity, a machine load and the like may be detected by sensors, and the processing times of the processes may be automatically calculated based on detected values by the control unit 22.

Also, the disturbance such as a power supply voltage, a motor characteristic, the number of sheets of a sheet bundle, a quality of a sheet, a temperature, a humidity, a machine load and the like may be detected by sensors, and an appropriate mode may be selected from the plurality of modes, based on detected values.

Also, brightness and noise levels of surrounding environments may be detected by sensors or the like, and the operation may be performed in the low speed mode in a dark environment or a quiet environment, and the operation may be performed in the high speed mode in a light environment or a noisy environment.

Also, a sensor configured to detect temperatures of the motor 28 may be provided, and the productivity may be improved by eliminating limitation of pause time (operation interval) for each binding operation until the motor 28 reaches a high temperature and influences binding performance.

Also, it is not necessarily required to control the operating times of all processes. For example, for the purpose of reducing the generated sound, only the process in which the generated sound is loud may be operated slowly, and for the purpose of reducing damage to the machine or sheet due to vibration or impact during the binding operation, only the process in which vibration or impact is high may be operated slowly. That is, in the case of the above purposes, all processes are not operated for a fixed time, but only a predetermined process may be operated for a fixed time (for example, only a predetermined process may be operated slowly or fast).

Also, as described above, when the binding operation is not completed within the preset predetermined time even though the control is performed so that the binding processing time T1 falls within the predetermined time (within the predetermined range), it may be determined that any abnormality has occurred in the apparatus or the like. For example, when the binding processing is not completed within the predetermined time, it may be determined that there is an abnormality in the apparatus or load. Also, it is possible to specify an abnormality occurrence process or an abnormality occurrence part, depending on which process the operation is delayed or stopped.

In addition to the operation of binding the sheet bundle, one or more modes for purpose of another operation may be provided. As one of the control modes, a mode in which the rotating amount of the motor 28 is detected and the electric stapler 20 is stopped in a predetermined state may be provided, and for example, the clincher part 64 may be brought close to the placement 66 to temporarily keep the electric stapler 20 in a low height state. By executing this mode, the electric stapler 20 can be kept in a state where a frontage into which a sheet bundle for which the binding processing is performed is inserted is closed, i.e., a compact state where the height of the electric stapler is lowered. Therefore, for example, it is possible to secure an operation space during maintenance of an inside of the post-processing apparatus.

Also, as another mode of the control modes, a mode in which a reciprocation operation in a predetermined section including the clinch process is performed more than once to perform the clinch operation more than once may be provided. By executing this mode, the bent leg portions of the staple are more closely contacted to the sheet surface, so that it is possible to prevent an object from being caught at a tip of the staple or a finger or the like from contacting the tip.

Also, as another mode of the control modes, a mode in which the reciprocation operation only in the clamp process is performed more than once to press the sheet bundle in the frontage of the electric stapler 20 more than once may be provided. By executing this mode, it is possible to make the sheet flat, so that it is possible to suppress the sheet from being curled. Also, there is a model of the electric stapler 20 where the sheet is inserted one by one into the frontage and the binding processing is performed at the time when a predetermined number of sheets is inserted to form a sheet bundle. At this time, when any one of the inserted sheets is curled, the sheet inserted next time may be caught at the curled part of the sheet inserted previously, so that the sheet may be difficult to be inserted into the frontage. Therefore, by executing the mode each time one sheet is inserted into the frontage, the sheet is made flat one by one to suppress the curling. Thereby, it is possible to improve insertability of the sheet into the frontage. Also, the sheet may be made flat in diverse positions by moving the electric stapler 20 inside the post-processing apparatus or the like.

In the penetration process, the staple formed into the U-shape is caused to penetrate the sheet bundle. At this time, in the penetration process, a next staple is formed in advance for next binding processing. For this reason, when performing the binding processing for the first time with unused coupled staples, since the staples have not been formed in advance, a head staple of the coupled staples is first formed in the penetration process, and the staple formed previously is caused to penetrate the sheet bundle when again returning to the penetration process via all the processes (the clinch process→, the return process→the clamp process). For this reason, when performing the binding processing for the first time with unused coupled staples, after causing the motor 28 to first rotate the gear 73 one extra rotation, the binding processing is performed during the second rotation. The first extra rotation prolongs the processing time and one rotation of the gear 73 generates a sound in each process. Therefore, after the forming is completed, the gear 73 may be reversed to return to the home position without via the clinch process and the return process, thereby shortening the processing time and reducing the generated sound.

Also, when the binding processing is completed and the clincher part 64 and the driver mechanism 60 return to the home position, a brake operation is normally performed at a timing at which the clincher part 64 and the like return to the home position, thereby stopping the clincher part 64 and the like in the home position. However, since a predetermined braking section is required until the clincher part 64 and the like are stopped, the clincher part 64 and the like may deviate from the home position (overrun) during the brake operation. Therefore, the control of starting the brake operation before returning to the home position may be performed. Thereby, it is possible to improve accuracy of stopping the clincher part 64 and the like in the home position.

Also, during the binding operation, it may be detected that after the clinch process is completed, the frontage is opened and the sheet bundle is thus released from the clamped state. Thereby, before the electric stapler 20 returns to the home position, the conveyance of the sheet bundle can be started, so that it is possible to further improve productivity when making a plurality of booklets.

What is claimed is:

1. An electric stapler configured to perform binding processing including a plurality of processes, the plurality of processes including a penetration process and other processes, the other processes including at least a clamp process and a clinch process, the clamp process clamping the sheet bundle, the penetration process causing a staple to penetrate the clamped sheet bundle, and the clinch process clinching leg portions of the penetrated staple, the electric stapler comprising:

a binding unit configured to execute the binding processing for a sheet bundle;

a motor configured to drive the binding unit; and a control unit configured to control the motor, wherein the control unit is configured to control the motor so that a rotating speed of the motor becomes faster in the penetration process than in the other processes, thereby adjusting processing times of the processes so that a binding processing time after the binding processing by the binding unit starts until the binding processing is completed falls within a predetermined range, wherein the control unit is configured to set a plurality of set target rotating speeds, and the set target rotating speeds are different for at least two different processes of the plurality of processes; and wherein for each process, the control unit is further configured to monitor the rotating speed of the motor and to control the motor so that an actual rotating speed of the motor follows a set target rotating speed of the plurality of set target rotating speeds.

2. The electric stapler according to claim 1, wherein the control unit is configured to control the motor to adjust the processing times of all the processes so that the binding processing time falls within the predetermined range.

3. The electric stapler according to claim 1, wherein the control unit is configured to control the motor to adjust the processing times of the processes so that the binding processing time is constant.

4. The electric stapler according to claim 1, wherein the control unit is configured to control the motor so that, in a process in which a rotating speed of the motor tends to decrease due to an influence of a disturbance, the rotating speed of the motor is increased.

5. The electric stapler according to claim 1, wherein the electric stapler has a plurality of modes in which the binding processing time is different, and wherein the control unit is configured to select any one of the modes, in response to a command from an outside, and to control the motor to adjust the processing times of the processes so that the binding processing time corresponds to the selected mode.

6. The electric stapler according to claim 5, wherein one of the plurality of modes is a low speed mode in which a sound generated during the binding processing is suppressed by setting the binding processing time to be slower than the binding processing times in the other modes.

7. The electric stapler according to claim 6, wherein another mode of the plurality of modes is a high speed mode in which the binding processing time is set to be faster than the binding processing times in the other modes.

8. The electric stapler according to claim 1, wherein the control unit is configured to control the motor so that a rotating speed of the motor is second highest in the clinch process.

9. The electric stapler according to claim 1, wherein the control unit is configured to control the motor so that a rotating speed of the motor in each process is to vary.

10. The electric stapler according to claim 1, wherein the control unit is configured to control the motor so that each processing time of each process follows a target processing time value preset for each process.

11. The electric stapler according to claim 10, wherein the control unit is configured to control the motor so that, in a process in which a rotating speed of the motor tends to decrease due to an influence of a disturbance, the rotating speed of the motor is increased.

12. The electric stapler according to claim 11, wherein the electric stapler has a plurality of modes in which the binding processing time is different, and wherein the control unit is configured to select any one of the modes, in response to a command from an outside, and to control the motor to adjust the processing times of the processes so that the binding processing time corresponds to the selected mode.

13. The electric stapler according to claim 12, wherein one of the plurality of modes is a low speed mode in which a sound generated during the binding processing is suppressed by setting the binding processing time to be slower than the binding processing times in the other modes.

14. The electric stapler according to claim 13, wherein another mode of the plurality of modes is a high speed mode in which the binding processing time is set to be faster than the binding processing times in the other modes.

15. The electric stapler according to claim 14, wherein the control unit is configured to control the motor so that a rotating speed of the motor is second highest in the clinch process.

16. The electric stapler according to claim 1, wherein the control unit is configured to compare a target processing time of the binding processing and an actual processing time of the binding processing and, based on a difference between the target processing time and the actual processing time, to control the rotating speed of the motor in subsequent processing so that a subsequent actual processing time of the binding processing becomes the target processing time.

17. The electric stapler according to claim 16, wherein the controller is configured to control the rotating speed of the motor in subsequent processing so that a sum of processing times for the plurality of processes becomes the target processing time.

18. The electric stapler according to claim 17, wherein the plurality of processes further includes a return process.

* * * * *